US009090829B1

(12) United States Patent
McGrevy et al.

(10) Patent No.: US 9,090,829 B1
(45) Date of Patent: Jul. 28, 2015

(54) APPARATUS FOR CONTROLLED BLOWING OF ASPHALT

(71) Applicants: Alan Nigel McGrevy, Lake Havasu City, AZ (US); Jack Nelson Dunigan, Benton, KY (US); Rocky C. Costello, Redondo Beach, CA (US)

(72) Inventors: Alan Nigel McGrevy, Lake Havasu City, AZ (US); Jack Nelson Dunigan, Benton, KY (US); Rocky C. Costello, Redondo Beach, CA (US)

(73) Assignee: STRATEGY LICENSING, LLC, Benton, KY (US)

( * ) Notice: Subject to any disclaimer, the term of this patent is extended or adjusted under 35 U.S.C. 154(b) by 0 days.

(21) Appl. No.: 14/476,216

(22) Filed: Sep. 3, 2014

(51) Int. Cl.
*C10C 3/04* (2006.01)

(52) U.S. Cl.
CPC ..... *C10C 3/04* (2013.01)

(58) Field of Classification Search
CPC ..... C10C 3/04
See application file for complete search history.

(56) References Cited

U.S. PATENT DOCUMENTS

| | | | | |
|---|---|---|---|---|
| 2,106,583 | A | 1/1938 | Webb | |
| 2,212,261 | A * | 8/1940 | Brothman | 366/264 |
| 3,557,956 | A | 1/1971 | Braun et al. | |
| 4,120,911 | A | 10/1978 | Davidson | |
| 6,471,392 | B1 | 10/2002 | Holl et al. | |
| 6,752,529 | B2 | 6/2004 | Holl | |
| 7,780,927 | B2 | 8/2010 | Holl | |
| 2013/0008828 | A1 * | 1/2013 | Bran et al. | 208/133 |

FOREIGN PATENT DOCUMENTS

| | | |
|---|---|---|
| GB | 1211139 | 11/1970 |
| JP | 2005/180106 | 7/2005 |
| JP | 456327 | 4/2008 |
| WO | WO03/056186 | 7/2003 |
| WO | WO2011/070589 | 6/2011 |
| WO | WO2012/088861 | 7/2012 |

* cited by examiner

*Primary Examiner* — Randy Boyer
(74) *Attorney, Agent, or Firm* — Cislo & Thomas, LLP

(57) ABSTRACT

An apparatus for controlled blowing of asphalt comprises a stator block, a rotor, a motor, a gap, a gas conduit, and a porous plug. The rotor resides within a cylindrical interior chamber of the stator block. When engaged, the motor causes the rotor to rotate about the longitudinal axis of the rotor. A porous plug is within a gas conduit at an opening into the interior chamber of the stator block. The porous plug allows the gas to pass from the gas conduit into the gap as tiny bubbles. In this way, the asphalt continuously enters the apparatus at the inlet end of the interior chamber, passes through a gap between the interior chamber and the rotor where gas is blown through the porous plug and into the asphalt while the motor rotates the rotor, and exits the apparatus at the outlet end of the interior chamber as blown asphalt.

17 Claims, 7 Drawing Sheets

APPARATUS FOR CONTROLLED BLOWING OF ASPHALT

TECHNICAL FIELD

This invention relates to apparatuses for oxidizing asphalt as well as their manufacture and use.

BACKGROUND

Current asphalt blowing systems require a lot of space, are difficult to maintain, need a large volume of gases to operate, emit undesirable fumes, and require a scrubber to filter out such fumes.

Asphalt flux is the asphaltic material that is derived from crude oil. In addition to the hydrocarbons, asphalt flux sometimes contains additives such as waxes or inorganic salts like ferric chloride. Asphalt flux is usually delivered by large, heated pipeline, tankers, or railcars to the processing facility, where temperatures may range from 90° C. to 204° C. At the processing facility, the asphalt flux is typically pumped or piped into large heated storage tanks, usually kept at 51+C. to 79° C. although some facilities store at temperatures as high as 230° C. Oil-fired, steam, or gas pre-heaters typically are used to maintain temperatures.

Asphalt air blowing is necessary for the production of converted asphalt flux into either of two roofing grades of asphalt, known as saturant grade and coating grade. These grades require the blowing process to achieve the desired softening points and to make them ready for coating or saturating the substrate roofing materials or shingles. The softening point of saturant asphalts is 0.40° C. to 74° C., while the softening point of coating asphalts is about 110° C. But the blowing of asphalt has been noted to be a primary source of organic emissions, including pivaloyloxymethyl (POM) emissions, in conventional asphalt blowing systems.

The configuration of a conventional blowing plant is shown in FIG. 1. Such a system typically includes an asphalt bulk supply tank 902, an asphalt blowing tank 904, an air or oxygen supply 906 to the asphalt blowing tank 904, a knock-out pot 908, and a finished-product bulk-storage 910. Materials exiting the knock-out pot 908 travel to a thermal oxidizer 912 or a knock-out oil storage tank 914. Such systems also generally include three asphalt process pumps 916 and two heat exchangers 918.

Existing designs typically have a vertical tank or horizontal asphalt blowing tank 904 and a sparger 920 that is either rotating or fixed. The sparger 920 has small holes in it, through which gases are passed to blow the asphalt. The conventional vertical tank configuration generally requires less gas than a conventional horizontal tank configuration due to the greater head height of the vertical tank.

Dire to the large size of existing tanks, they require a greater amount of heat and energy to maintain blowing temperatures required during the blowing cycle than would a smaller tank. The existing systems also require the spraying of steam or water onto the asphalt flux surface to help control the exothermic nature of the process and maintain the desired temperature of around 260° C. Overheating is also a problem in stirred tank designs, where it is critical to keep the asphalt flux at least 28° C. below its flash point as the asphalt is being blown (as specified by the U.S. Environmental Protection Agency in 1980). Due to the large volume inside the stirred tanks, it is also difficult to make sure all of the asphalt flux reaches the san temperature and has uniform gas distribution to induce the exothermic reaction.

Accordingly, there is a need for an asphalt blowing system that is safer, less volatile, more consistent, and more continuous than the conventional apparatus and systems. There is also a need for a system that takes up less space and is easier to operate and maintain.

SUMMARY

The present invention is directed to an apparatus that is safer, less volatile, more consistent, and more continuous than the conventional apparatus and systems.

The new invention is shown schematically within the system depicted in FIG. 2. A system using the new apparatus typically includes an asphalt bulk supply tank 902, the apparatus for controlled blowing of asphalt 100, an air or oxygen supply 906 to the apparatus for controlled blowing of asphalt 100, a knock-out pot 908, and a finished-product hulk-storage 910. Materials exiting the knock-out pot 908 travel to a thermal oxidizer 912 or the finished-product bulk-storage 910. The system also typically includes two asphalt process pumps 916 and two heat exchangers 918. Accordingly, the new apparatus for controlled blowing of asphalt can be incorporated into existing systems by eliminating the asphalt blowing tank 904.

The new apparatus takes up less space, is easier to operate and maintain, and eliminates the large blowing tank and emissions from such tanks.

In one aspect of the invention, the apparatus for controlled blowing of asphalt comprises a stator block, a rotor, a motor, a gap, a gas conduit, and a porous plug to convert asphalt flux into blown asphalt in a way that is safer, less volatile, more consistent, and more continuous than with conventional systems.

The stator block comprises a casing surrounding a cylindrical interior chamber. The interior chamber has an inlet end and an outlet end, and the interior chamber has an inner diameter.

The rotor resides within the cylindrical interior chamber of the stator block, and the stator block surrounds and encases the rotor. The rotor extends from the inlet end of the stator block to the outlet end of the stator block. The rotor is generally cylindrical and has a longitudinal axis and an outer diameter. The rotor is rotatable about the longitudinal axis within the interior chamber of the stator block.

The motor is connected to the rotor such that, when engaged, the motor causes the rotor to rotate about the longitudinal axis of the rotor within the interior chamber of the stator block.

The gap is the space between the inner diameter of the stator block and the outer diameter of the rotor. The gap has a width, which is half of the difference between the inner diameter of the stator block and the outer diameter of the rotor.

The gas conduit is within the casing of the stator block and conveys gas at a selected pressure. The gas conduit has an opening into the interior chamber of the stator block through the inner diameter of the interior chamber.

The porous plug is within the gas conduit at the opening into the interior chamber of the stator block. Preferably, the porous plug spans the opening. The porous plug allows the gas to pass from the gas conduit into the gap only as tiny, gas bubbles. Preferably, the gas bubbles have a diameter of less than about twenty microns.

In this way, the asphalt continuously enters the apparatus at the inlet end of the interior chamber, passes through the gap where gas is blown through the porous plug and into the asphalt bile the motor rotates the rotor, and exits the apparatus at the outlet end of the interior chamber as blown asphalt.

In another aspect of the invention, a method tier the controlled blowing of asphalt comprises providing an apparatus for controlled blowing of asphalt, rotating the rotor about the longitudinal axis of the rotor, continuously pumping asphalt flux into the inlet end of the interior chamber, continuously supplying gas to the gas conduit at the selected pressure to produce the gas bubbles from the porous plug, and passing the asphalt flux through the gap from the inlet end of the interior chamber to the outlet end of the interior chamber.

The provided apparatus for controlled blowing of asphalt comprises a stator block, a rotor, a gap, a gas conduit, and a porous plug. The stator block comprises a casing surrounding a cylindrical interior chamber. The interior chamber has an inlet end and an outlet end, and the interior chamber also has an inner diameter.

The rotor resides within the cylindrical interior chamber of the stator block, and the stator block surrounds and encases the rotor. The rotor extends from the inlet end of the stator block to the outlet end of the stator block. The rotor is cylindrical and has a longitudinal axis and an outer diameter. The rotor is rotatable about the longitudinal axis within the interior chamber of the stator block.

The gap is the space between the inner diameter of the stator block and the outer diameter of the rotor. The gap has a width defined as half of the difference between the inner diameter of the stator block and the outer diameter of the rotor.

The gas conduit is within the casing of the stator block and conveys gas at a selected pressure. The gas conduit has an opening into the interior chamber of the stator block through the inner diameter of the interior chamber.

The porous plug is within the gas conduit at the opening into the interior chamber of the stator block. The porous plug spans the opening, and it allows the gas to pass from the gas conduit into the gap only as gas bubbles. The gas bubbles each have a diameter of less than about twenty microns.

As the rotor rotates, the rotor creates a circumferential flow of the asphalt flux and the gas bubbles around the rotor, and the asphalt flux exits the outlet end of the interior chamber as blown asphalt.

The new apparatus and method require less air flow and has no direct emissions from the asphalt flux within the apparatus. This is because it is processed in a continuous stream, where gas is blown into the annulus of the flow channel into the passing asphalt flux, as described more fully elsewhere in this disclosure.

The new invention also requires a smaller amount of heat to maintain temperatures within its smaller footprint, relative to the existing stirred tank methods. The new invention also eliminates the need for spraying steam and water onto the asphalt flux surface, which is required by existing stirred-tank designs.

Because of the small volume passing at a fast, continuous rate through the new apparatus, the new apparatus also eliminates the problem in existing systems of keeping the asphalt flux at the same temperature and ensuring uniform distribution of gas to induce the exothermic reaction. That is, in the new apparatus, the asphalt flux may only be in the process area within the apparatus for seconds as opposed to between 1.5 and 14 hours in a stirred-tank design.

DETAILED DESCRIPTION OF THE INVENTION

Figure 1:
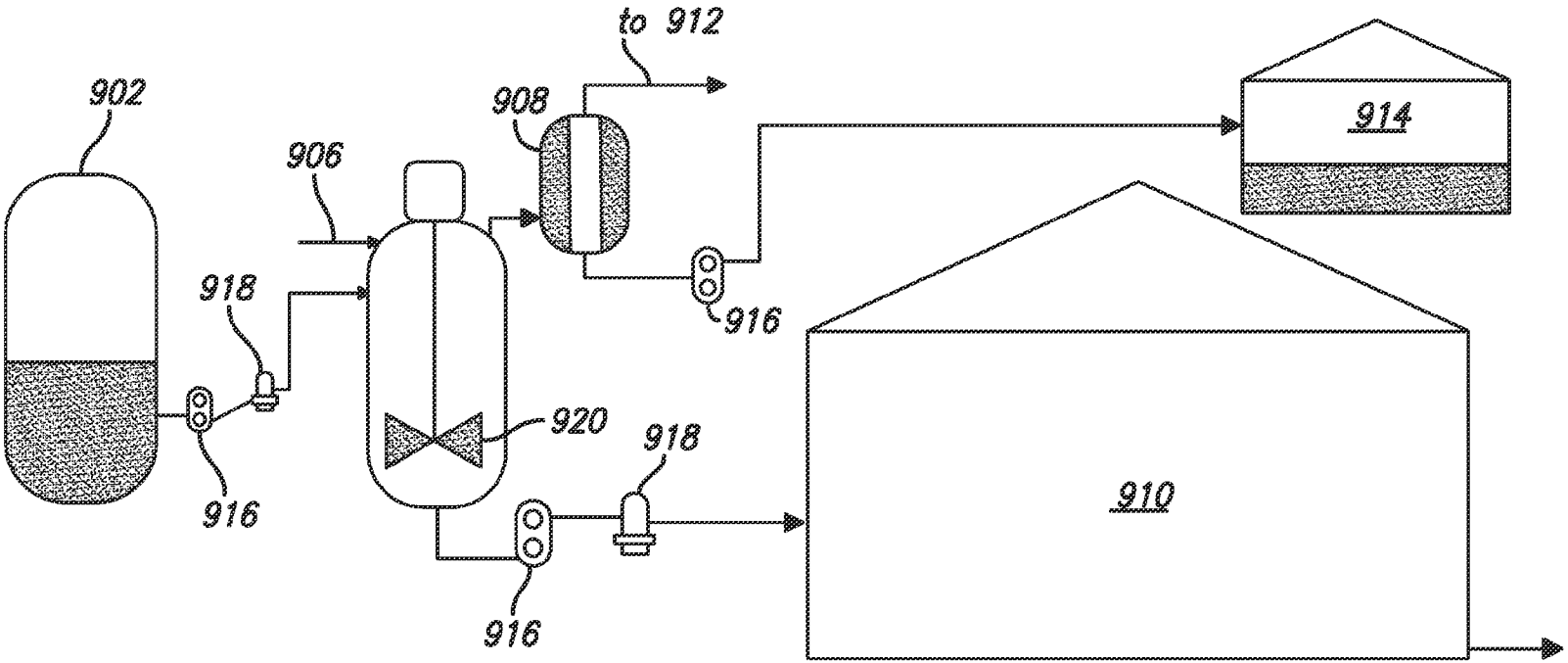
FIG. 1 PRIOR ART
FIG. 1 is a schematic of a conventional blowing plant.
Figure 2:
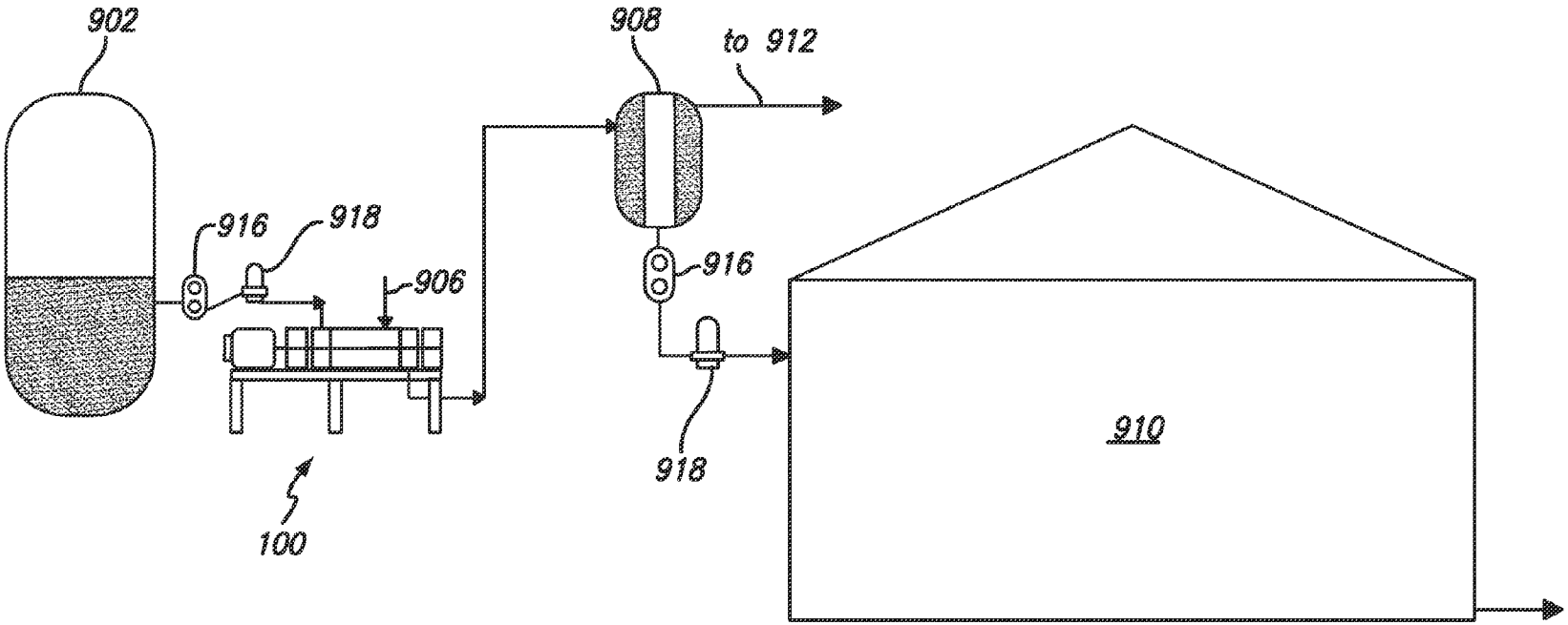
FIG. 2 is a schematic of a system that includes an embodiment of the Apparatus for Controlled Blowing of Asphalt.
Figure 3:
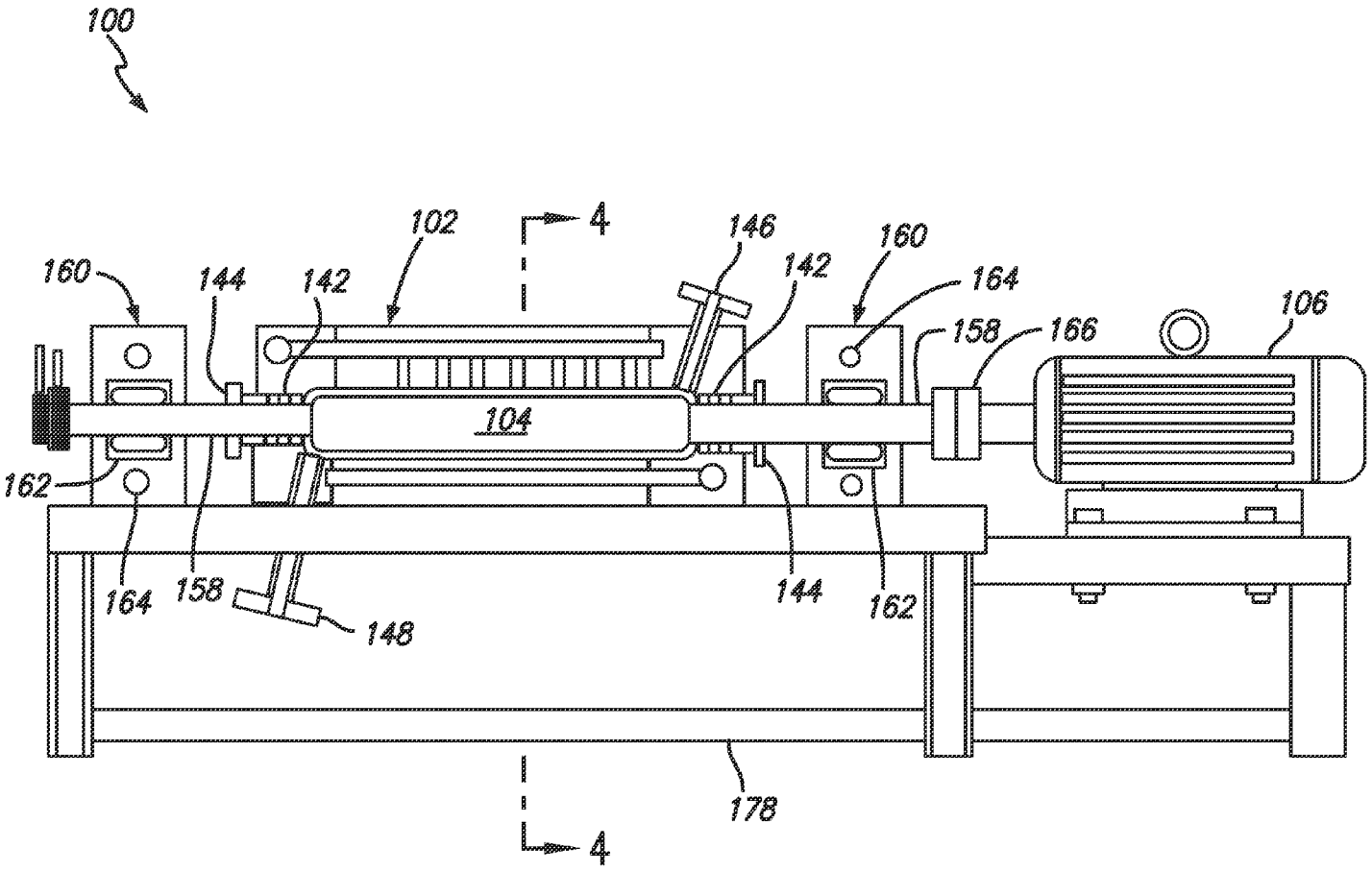
FIG. 3 is a schematic of an embodiment of the Apparatus for Controlled Blowing of Asphalt, showing the relative positioning of the components in the depicted embodiment.
Figure 4:
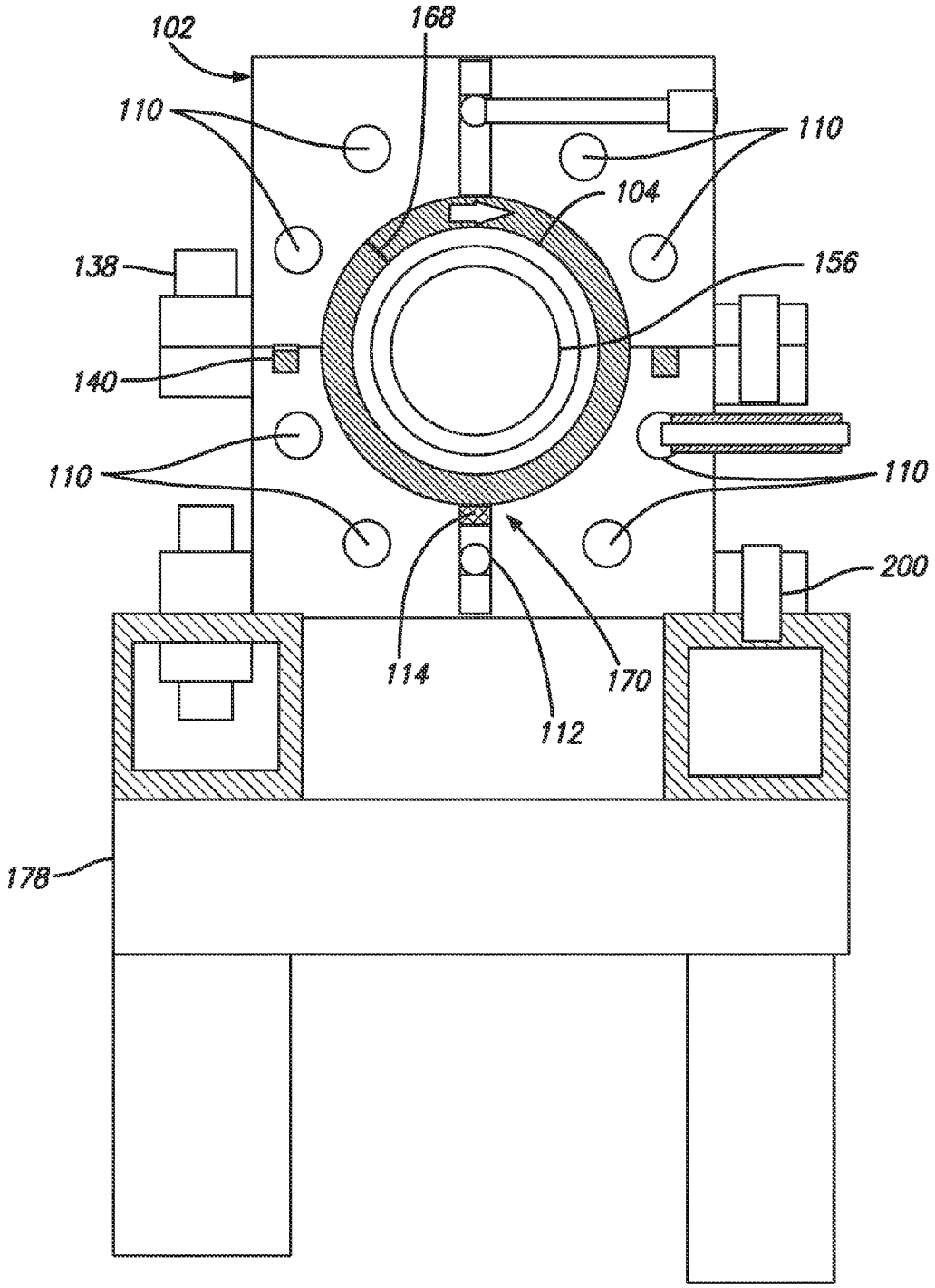
FIG. 4 is a sectional view of the schematic shown in FIG. 3, taken along the line 4-4.
Figure 5:
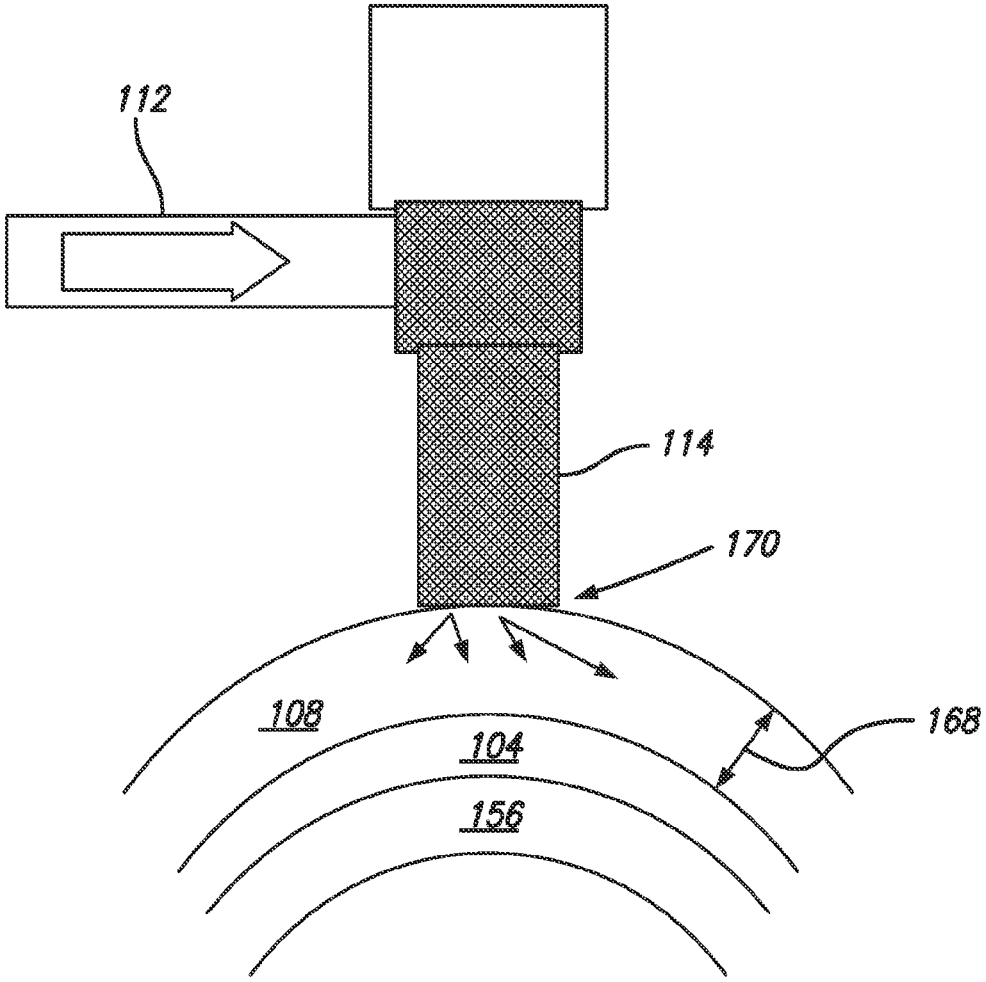
FIG. 5 is a detailed view of an area near a porous plug.
Figure 6:
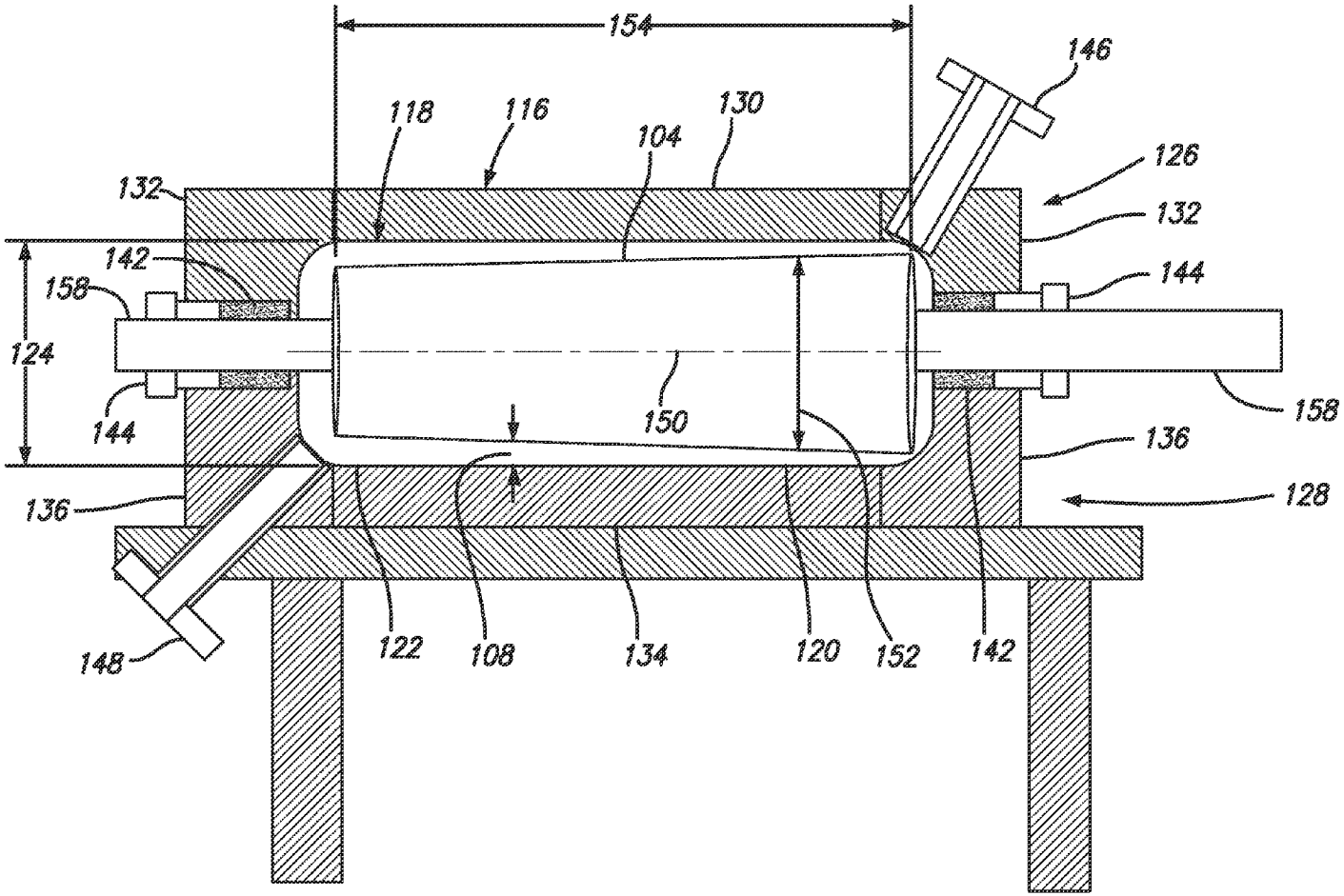
FIG. 6 is a detailed, sectional view of the rotor and stator block portion of the schematic shown in FIG. 3, showing a tapered rotor.
Figure 7:
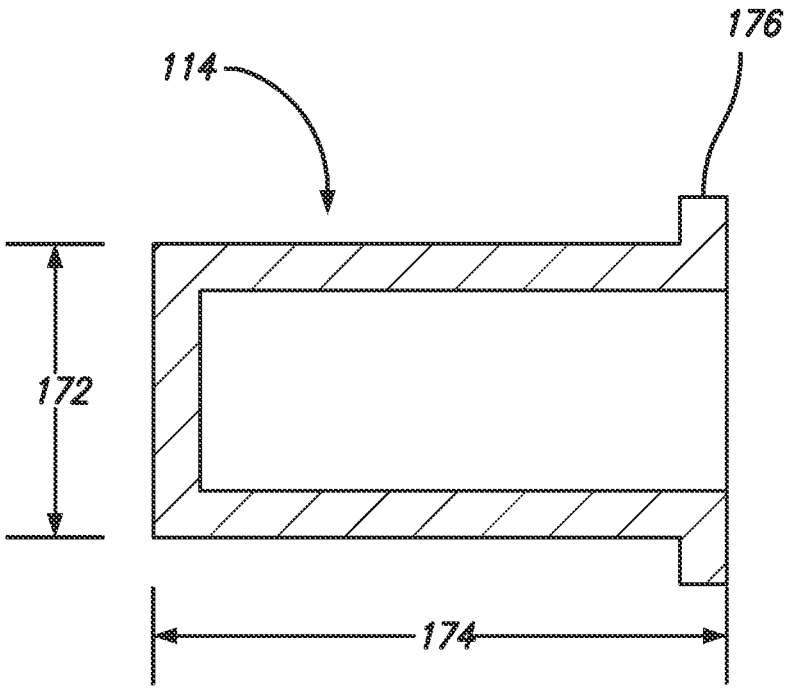
FIG. 7 is a detailed view of a version of a porous plug, the porous plug being sectioned along its length.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

As used in this disclosure, the terms "gas" or "gases" shall mean air, enriched air (air having an oxygen content of greater than about 23% of its mass), or pure oxygen. These are the gases that are presently used in the industry to create blown asphalt.

Referring to the figures, the apparatus for controlled blowing of asphalt 100 comprises a stator block 102, a rotor 104, a motor 106, a gap 108, a gas conduit 112, and a porous plug 114 to convert asphalt flux into blown asphalt in a way that is safer, less more consistent, and more continuous than with conventional systems.

The stator block 102 comprises a casing 116 surrounding a cylindrical interior chamber 118. The interior chamber 118 has an inlet end 120 and an outlet end 122, and the interior chamber 118 has an inner diameter 124.

In a version of the invention, the stator block 102 has a split-section design. That is, the stator block 102 comprises an upper stator block 126 and a lower stator block 128. The upper stator block 126 further comprises an upper mid stator block 130 and two upper compression seal blocks 132. The upper mid stator block 130 is between the two upper compression seal blocks 132. The lower stator block 128 further comprises a lower mid stator block 134 and two lower compression seal blocks 136. The lower mid stator block 134 is between the two lower compression seal blocks 136. The components of the split-section design are held together by a series of bolts 138, which clamp the components together for a gas-tight assembly. Preferably, a sealing member 140 is between two or more of the components to better seal the joint between two adjacent components of the split-section design. The sealing member 140 preferably comprises packing material that can withstand temperatures in excess of 300° C. and pressures in excess of 1,000 psi. Most preferably, the packing material has a graphite-filled fiber construction, such as what is typically used is gland-type stuffing boxes.

Each of the upper compression seal blocks 132 and the lower compression seal blocks 136 further accommodates compression seals 142. The compression seals 142 are preferably high-temperature, graphite-filled compression seals 142. Such graphite-filled seals are generally less expensive than mechanical seals, and they are easy to replace or adjust the compression of the sealing media while in place. In this way, the upper compression seal blocks 132 and the lower compression seal blocks 136 provide a stuffing box design for high-temperature sealing between the rotor 104 and the upper compression seal blocks 132 and the lower compression seal blocks 136. The compression seals 142 are preferably compressed by adjusting a torsion nut 144 to form a gas-tight seal around the rotor 104. In the preferred embodiment, there are four compression seals 142 at each end of the rotor 104.

One advantage of the split-section design for the stator block 102 is that it facilitates cleaning and maintenance of the apparatus for controlled blowing of asphalt 100. That is, the smaller size of the apparatus for controlled blowing of asphalt 100 (as compared to a conventional asphalt blowing tank) and the more manageable size of the components (since the stator block 102 is split into several sections) allow the apparatus for controlled blowing of asphalt 100 to be more easily dismantled. This new design also greatly reduces the long downtime necessary to maintain conventional asphalt blowing tanks, and it eliminates the hazardous closed-space work required for conventional tanks, where a worker must enter the tank to clean its interior.

Preferably, the stator block 102 is constructed from steel. In versions of the invention, the steel could be tool steel or pre-hardened stainless steel. The steel could also be treated with a salt bath nitride process to create a smooth, hard surface with hardness impingement into the substrate steel. This process gives the steel good wear and chemical resistance properties.

In some versions, the apparatus for controlled blowing of asphalt 100 further comprises a process inlet port 146 and a process outlet port 148. Preferably, the process inlet port 146 and the process outlet port 148 are each heated. The process inlet port 146 is connected to the inlet end 120 of the interior chamber 118, and the process outlet port 148 is connected to the outlet end 122 of the interior chamber 118. The process inlet port 146 has a cross-sectional area, the cross-sectional area being perpendicular to a flow of asphalt through the process inlet port 146. In versions of the invention where the interior of the process inlet port 146 is a round pipe, the cross-sectional area of the process inlet port 146 is given by the usual equation for the area of a circle, using the radius of the pipe as the radius of the circle in the equation.

In the preferred version, the process inlet port 146 is disposed within one of the upper compression seal blocks 132, while the outlet process port is disposed within one of the lower compression seal blocks 136. In some versions, there is more than one process inlet port 146 to accommodate, for example, asphalt and binders in different process inlet ports 146.

The rotor 104 resides within the cylindrical interior chamber 118 of the stator block 102, and the stator block 102 surrounds and encases the rotor 104. The rotor 104 extends from the inlet end 120 of the interior chamber 118 to the outlet end 122 of the interior chamber 118. The rotor 104 is generally cylindrical and has a longitudinal axis 150 and an outer diameter 152. The rotor 104 is rotatable about the longitudinal axis 150 within the interior chamber 118 of the stator block 102.

In a version of the invention, the rotor 104 has a length 154 and is tapered along the longitudinal axis 150. As such, the gap 108 at the inlet end 120 of the interior chamber 118 is less than the gap 108 at the outlet end 122 of the interior chamber 118. Preferably, the difference between the gap 108 at the outlet end 122 and the gap 108 at the inlet end 120 is 2.5% to 5% of the gap 108 at the inlet end 120 times the length 154 of the rotor 104. By way of example, if the gap 108 at the inlet end 120 is 0.050 inch, the rotor length 154 is 2.0 inches, and the taper is 2.5%, then the gap 108 at the outlet end 122 would be $0.050+(0.025\times0.050\times20)=0.075$ inch.

In versions of the invention having a tapered rotor 104, the asphalt pumping pressure is less than what it would be for a rotor 104 not having a taper. That is, it is well known that a fluid flowing through a pipe or tubular section can create a pressure drop relative to the length of the pipe or tubular section. So, the pipe requires extra pressure at the inlet to maintain a desired flow rate. The tapered rotor 104 creates a widening gap 108 between the rotor 104 and the inner diameter 124 of the interior chamber 118, which addresses this issue and helps to keep the pumping pressures within range of a standard asphalt pump's capabilities. In this way, the asphalt pump can maintain the desired flow rate of asphalt through the gap 108.

Preferably, the rotor 104 is hollow, meaning that it comprises a cylindrical tube. The hollow rotor 104 helps to minimize the weight of the apparatus and stress on the bearings 162 in the bearing blocks 160 (discussed below). The hollow rotor 104 also helps enhance the heat transfer from the stator block 102 to the rotor 104.

In versions having a hollow rotor 104, the rotor 104 may further comprise a sleeve 156 inside the rotor 104. The sleeve 156 preferably provides weight control and temperature control. The sleeve 156 provides weight control by balancing the spinning rotor 104, and the sleeve 156 provides temperature control by being heat conductive. Accordingly, the sleeve 156 is preferably made from copper or aluminum, both of which are known to have excellent heat conducting and retaining properties. The sleeve 156 helps to promote uniform heat conduction and retention in the rotor 104 and to maintain a temperature similar to that of the stator block 102. Typically, that temperature would be about 260° C. The space surrounded by the sleeve 156 contains air, so it is also a good insulator. Likewise, in versions without a sleeve 156, the space surrounded by the rotor 104 contains insulating air.

In some versions, the space surrounded by the rotor 104 or the space surrounded by the sleeve 156 includes a heating or cooling system to further help control the temperature of the rotor 104. In such versions, one or more rotary unions are included on the rotor 104 for permit heating or cooling media to get into and out of the heating or cooling system in the rotor 104.

In a version of the invention, the rotor 104 includes a rotor shaft 158 at each end of the rotor 104. Since the rotor 104 has two ends, the ends are denoted the first end and the second end. Preferably, a bearing block 160 supports each rotor shaft 158. Each bearing block 160 accurately positions and holds the rotor 104 concentrically within the cylindrical interior chamber 118 of the stator block 102. The bearing block 160 preferably comprises a split, high-temperature, high-speed bearing 162. The bearing block 160 may also include one or more cooling channels 164 to cool the bearing block 160. The cooling channel 164 cools the bearing block. 160 by providing a conduit for circulating coolant oil. In the preferred embodiment, the bearing blocks 160 are off-the-shelf items, which makes them readily replaceable. Using readily replaceable components helps reduce downtime and the cost of maintenance.

The motor 106 is connected to the rotor 104 such that, when engaged, the motor 106 causes the rotor 104 to rotate about the longitudinal axis 150 of the rotor 104 within the interior chamber 118 of the stator block 102. As the rotor 104 rotates, it creates a circumferential flow of the asphalt and gas bubbles (from the porous plug 114, discussed below) around the rotor 104. The circumferential flow is preferably turbulent since the gas bubbles disrupt the laminar flow of asphalt through the gap 108. This helps facilitate and control the blowing of the asphalt. In a version of the invention, the motor 106 is connected to the rotor 104 through one of the rotor shafts 158. The connection between the motor 106 and the rotor 104 may include a flex coupling 166. Preferably, the motor 106 is an electric motor 106.

The gap 108 is the space between the inner diameter 124 of the interior chamber 118 and the outer diameter 152 of the rotor 104. The gap 108 has a width 168, which is half of the difference between the inner diameter 124 of the interior chamber 118 and the outer diameter 152 of the rotor 104. The cross-sectional area of the gap 108, which is annular, is given by the usual formula for the area of an annulus, with the outer diameter 152 of the rotor 104 and the inner diameter 124 of the interior chamber 118 being the two diameters for the formula. Preferably, the cross-sectional area of the gap 108 is sized such that it is equal to the cross-sectional area of the process inlet port 146. In versions of the apparatus having a tapered rotor 104, the cross-sectional area of the gap 108 at the inlet end 120 of the interior chamber 118 is sized such that it is equal to the cross-sectional area of the process inlet port 146. Preferably, the surfaces that comprise the diameter 124 of the interior chamber 118 and the outer diameter 152 of the rotor 104 have a machined finish between 16 and 32 micro-inches.

Preferably, the apparatus for controlled blowing of asphalt 100 also includes a heated passage 110. The heated passage 110 is within the casing 116 of the stator block 102. The heated passage 110 is a conduit for heated oil or steam to control the temperature of the stator block 102. In some versions, the stator block 102 may further include one or more temperature sensors to monitor the temperature of the stator block 102. Preferably, the heated passage 110 is a gun-drilled hole, or a network of connected gun-drilled holes, in the stator block 102. Conventional systems commonly use heating sources that are clamped around the outer areas of the various components of the system. But it is more efficient to use heated oil or steam in a heated passage 110 to control the temperature of the stator block 102. This new method is also safer since there are fewer external pipes to insulate and connect. In some versions of the invention, there is also an external heating or cooling jacket on the stator block 102 to control the temperature of the stator block 102.

The gas conduit 112 is within the casing 116 of the stator block 102 and conveys gas at a selected pressure. The gas conduit 112 has an opening 170 into the interior chamber 118 of the stator block 102 through the inner diameter 124 of the interior chamber 118. Preferably, the gas conduit 112 is a gun-drilled hole, or a network of connected gun-drilled holes, in the stator block 102.

The porous plug 114 is within the gas conduit 112 at the opening 170 into the interior chamber 118 of the stator block 102. Preferably, the porous plug 114 spans the opening 170. The porous plug 114 allows the gas to pass from the gas conduit 112 into the gap 108 only as tiny, gas bubbles. Preferably, the gas bubbles have a diameter of less than about twenty microns. Most preferably, the diameter of the gas bubble is between 3 to 7 microns. In a version of the invention, the porous plug 114 is comprised of sintered, porous metal, having an average pore size of 7 to 20 microns and a porosity of about 25% air by volume. These dimensions allow gas to pass through the porous plug 114, but they are not large enough to allow asphalt to pass through under pressure. Preferably, the porous plug 114 has a diameter 172 of ¾ inch, a length 174 of 1 inch, and a head 176 on one end. In the preferred embodiment, there is an array of porous plugs 114 placed along and around the cylindrical interior chamber 118 of the stator block 102.

Accordingly, the asphalt continuously enters the apparatus at the inlet end 120 of the interior chamber 118, passes through the gap 108 where gas is blown through the porous plug 114 and into the asphalt while the motor 106 rotates the rotor 104, and exits the apparatus at the outlet end 122 of the interior chamber 118 as blown asphalt.

Preferably, the apparatus for controlled blowing of asphalt 100 is mounted onto a skid 178, such as a C-channel or box-channel frame. The skid 178 might include location dowels 200 to accurately align the different parts of the apparatus, particularly the bearing blocks 160 and the components of the stator block 102 having a split-section design.

Although not required, in practice users would possibly enclose the entire apparatus for controlled blowing of asphalt 100 in an insulated sheathing. This is a common practice for heated vessels in asphalt blowing facilities.

In the preferred embodiment, the apparatus for controlled blowing of asphalt 100 measures approximately 12 feet (about 3.7 meters) by 6 feet (about 1.8 meters) by 8 feet (about 2.4 meters) with an internal volume (fix asphalt processing) of about 1.5 cubic feet (42 liters).

Residence times for asphalt within the gap 108 of the apparatus are around 2 seconds or less. Accordingly, as compared to conventional designs, the apparatus described here processes a much smaller volume of asphalt at a much faster flow rate. The much smaller amount of asphalt being processed at one time also means the processing is much less volatile than in a conventional stirred tank design; so fewer fumes are being produced and emitted by the apparatus.

In this way, the disclosed apparatus provides a safer, less volatile, more consistent, and more continuous way to produce blown asphalt when compared to conventional systems. The disclosed apparatus also takes up less space, is easier to operate and maintain, and eliminates the large blowing tank and emissions from such tanks. The smaller volume also means that fewer solvents are needed to clean the interior of the apparatus. And the use of one or more porous plugs 114, placed along and around the cylindrical interior chamber 118 of the stator block 102, reduces the amount of gas used in the blowing process.

Further, the only moving parts are the motor 106, the rotor 104, and the bearing 162 within each bearing block 160. This helps reduce downtime and the cost of maintenance.

While the present invention has been described with regards to particular embodiments, it is recognized that additional variations of the present invention may be devised without departing from the inventive concept.

What is claimed is:

1. A method for the controlled blowing of asphalt, the method comprising:

(a) providing an apparatus for controlled blowing of asphalt, the apparatus comprising:

(i) a stator block, the stator block comprising a casing surrounding a cylindrical interior chamber, the interior chamber having an inlet end and an outlet end, the interior chamber further having an inner diameter;

(ii) a rotor residing within the cylindrical interior chamber of the stator block, the stator block surrounding and encasing the rotor, the rotor extending from the inlet end of the stator block to the outlet end of the stator block, the rotor being cylindrical and having a longitudinal axis and an outer diameter, the rotor being rotatable about the longitudinal axis within the interior chamber of the stator block;

(iii) a gap, the gap being the space between the inner diameter of the stator block and the outer diameter of the rotor, the gap having a width defined as half of the difference between the inner diameter of the stator block and the outer diameter of the rotor;

(iv) a gas conduit within the casing of the stator block, the gas conduit conveying gas at a selected pressure, the gas conduit having an opening into the interior chamber of the stator block through the inner diameter of the interior chamber; and (v) a porous plug, the porous plug being within the gas conduit at the opening into the interior chamber of the stator block, the porous plug spanning the opening, the porous plug allowing the gas to pass from the gas conduit into the gap only as gas bubbles, the gas bubbles having a diameter of less than about twenty microns;

(b) rotating the rotor about the longitudinal axis of the rotor;

(c) continuously pumping asphalt flux into the inlet end of the interior chamber;

(d) continuously supplying gas to the gas conduit at the selected pressure to produce the gas bubbles from the porous plug; and (e) passing the asphalt flux through the gap from the inlet end of the interior chamber to the outlet end of the interior chamber, the time for a particular portion of the asphalt flux to pass through the gap from the inlet end to the outlet end defining a residence time;

whereby, as the rotor rotates, the rotor creates a circumferential flow of the asphalt flux and the gas bubbles around the rotor; and whereby, the asphalt flux exits the outlet end of the interior chamber as blown asphalt.

2. The method of claim 1, the residence time being two seconds or less.

3. The method of claim 1, the provided rotor being tapered along the longitudinal axis such that the gap at the inlet end of the stator block is less than the gap at the outlet end of the stator block.

4. The method of claim 2, wherein the difference between the gap at the outlet end and the gap at the inlet end is 2.5% to 5% of the gap at the inlet end times the length of the rotor.

5. The method of claim 2, wherein the apparatus further comprises a process inlet port, the process inlet port being connected to the inlet end of the interior chamber, the process inlet port having a cross-sectional area perpendicular to a flow of asphalt through the process inlet port, the gap having an annular cross-sectional area, the annular cross-sectional area of the gap at the inlet end of the interior chamber being equal to the cross-sectional area of the process inlet port.

6. The method of claim 1, wherein the apparatus further comprises a heated passage within the casing of the stator block, the heated passage being a conduit for heated oil or steam to control a temperature of the stator block.

7. The method of claim 1, wherein the apparatus further comprises a process inlet port, the process inlet port being connected to the inlet end of the interior chamber, the process inlet port having a cross-sectional area, the cross-sectional area being perpendicular to a flow of asphalt through the process inlet port.

8. The method of claim 7, wherein the gap further comprises an annular cross-sectional area, the annular cross-sectional area being plus or minus five percent of the cross-sectional area of the process inlet port.

9. The method of claim 1, wherein the gas bubbles have a diameter between 3 to 7 microns.

10. The method of claim 1, wherein the apparatus comprises a rotor that has a hollow, cylindrical tube.

11. The method of claim 10, wherein the rotor further comprises a sleeve inside the rotor, the sleeve being copper or aluminum.

12. The method of claim 1, wherein the rotor further comprises a first rotor shaft at a first end of the rotor and a second rotor shaft at a second end of the rotor, the method further comprising a first bearing block to support the first rotor shaft and a second bearing block to support the second rotor shaft, the first bearing block and the second bearing block together accurately positioning and holding the rotor within the interior chamber of the stator block.

13. The method of claim 12, wherein the first bearing block and the second bearing block of the rotor each comprises a cooling channel to cool the bearing block and a split, high-temperature, high-speed bearing.

14. The method of claim 1, wherein the porous plug comprises an array of porous plugs placed along and around the interior chamber of the stator block.

15. The method of claim 1, wherein the apparatus further comprises a skid to support the method, the skid comprising a metal frame.

16. The method of claim 1, wherein the stator block has a split-section design, the split-section design comprising:

(a) an upper stator block, the upper stator block comprising an upper mid stator block and two upper compression seal blocks, the upper mid stator block being clamped between the two upper compression seal blocks; and (b) a lower stator block, the lower stator block comprising a lower mid stator block and two lower compression seal blocks, the lower mid stator block being between clamped the two lower compression seal blocks.

17. The method of claim 16, wherein the two upper compression seal blocks and the two lower compression seal blocks each accommodate at least one compression seal for sealing against the rotor, the two upper compression seal blocks and the two lower compression seal blocks thus provide a stuffing box for high-temperature sealing between the rotor and the upper compression seal blocks as well as between the rotor and the lower compression seal blocks.

* * * * *